US011111825B1

(12) United States Patent
Wang et al.

(10) Patent No.: US 11,111,825 B1
(45) Date of Patent: Sep. 7, 2021

(54) HYDRAULIC VALVE MECHANISM WITH VARIABLE VALVE OPENING TIMES AND INTERNAL COMBUSTION ENGINE

(71) Applicant: LONGKOU ZHONGYU INVESTMENT HOLDING LTD.

(72) Inventors: Zhaoyu Wang, Shandong (CN); Zongfa Xie, Shandong (CN); Kang Han, Shandong (CN)

(73) Assignee: LONGKOU ZHONGYU INVESTMENT HOLDING LTD., Shandong (CN)

( * ) Notice: Subject to any disclaimer, the term of this patent is extended or adjusted under 35 U.S.C. 154(b) by 0 days.

(21) Appl. No.: 15/733,893

(22) PCT Filed: Mar. 18, 2020

(86) PCT No.: PCT/CN2020/080041
§ 371 (c)(1),
(2) Date: Dec. 1, 2020

(87) PCT Pub. No.: WO2021/008155
PCT Pub. Date: Jan. 21, 2021

(30) Foreign Application Priority Data

Jul. 12, 2019 (CN) ..... 201910630613.6

(51) Int. Cl.
*F01L 1/34* (2006.01)
*F01L 1/344* (2006.01)
(Continued)

(52) U.S. Cl.
CPC ..... *F01L 1/3442* (2013.01); *F01L 1/08* (2013.01); *F01L 13/06* (2013.01);
(Continued)

(58) Field of Classification Search
CPC . F01L 1/3442; F01L 1/08; F01L 13/06; F01L 2305/00; F01L 2001/34426; F01L 2313/00
See application file for complete search history.

(56) References Cited

U.S. PATENT DOCUMENTS 6,422,186 B1 * 7/2002 Vanderpoel ..... F01L 1/2411 123/90.15
6,439,195 B1 8/2002 Warner
2004/0103868 A1 6/2004 Engelberg

FOREIGN PATENT DOCUMENTS

CN 102727880 10/2012
CN 108779689 11/2018
(Continued)

OTHER PUBLICATIONS

"International Search Report (Form PCT/ISA/210) of PCT/CN2020/080041," dated May 15, 2020, with English translation thereof, pp. 1-8.

*Primary Examiner* — Zelalem Eshete
(74) *Attorney, Agent, or Firm* — JCIP Global Inc.

(57) ABSTRACT

The present invention discloses a hydraulic valve mechanism with variable valve opening times and an internal combustion engine, which can effectively implement a single-opening working mode, a two-opening working mode or a multi-opening working mode of a valve in the same working cycle, and can implement a rapid and stable switchover among various working modes according to working condition requirements of the internal combustion engine. A main structure thereof includes a housing, a valve cam including a main protrusion and at least one auxiliary protrusion, a hydraulic rotary valve having a hydraulic switch valve function, a hydraulic drive component, a valve drive component, and the like. Oil passages of the hydraulic
(Continued)

drive component, the hydraulic rotary valve, and the valve drive component are in communication.

10 Claims, 5 Drawing Sheets

(51) Int. Cl.
*F01L 1/08* (2006.01)
*F01L 13/06* (2006.01)

(52) U.S. Cl.
CPC . *F01L 2001/34426* (2013.01); *F01L 2305/00* (2020.05); *F01L 2313/00* (2020.05)

(56) References Cited

FOREIGN PATENT DOCUMENTS

| | | |
|---|---|---|
| CN | 108868935 | 11/2018 |
| CN | 110344908 | 10/2019 |

* cited by examiner 3-2
3-1
3-1-3
3
7-2
7-1
7
2-4
2-3
2-2
3-3
A
2-1
2
1-2
5-3
5-2
5-1
5
A
6
4
4-1
4-2
1-1
1

HYDRAULIC VALVE MECHANISM WITH VARIABLE VALVE OPENING TIMES AND INTERNAL COMBUSTION ENGINE

CROSS-REFERENCE TO RELATED APPLICATION

This application is a 371 of international application of PCT application serial no. PCT/CN2020/080041, filed on Mar. 18, 2020, which claims the priority benefit of China application no. 201910630613.6, filed on Jul. 12, 2019. The entirety of each of the above mentioned patent applications is hereby incorporated by reference herein and made a part of this specification.

BACKGROUND

Technical Field

The present invention relates to a valve mechanism of an internal combustion engine, and in particular, to a hydraulic valve mechanism with variable valve opening times of an internal combustion engine in a working cycle and an internal combustion engine.

Related Art

When a conventional internal combustion engine is in a working state, an intake valve is opened during an intake process, and an exhaust valve is opened during an exhaust process. That is, the intake valve and the exhaust valve only need to be opened once in one working cycle. However, with the continuous development and improvement of internal combustion engine technologies, in some situations, it is urgent for the internal combustion engine to reopen the valve or open even many times in one working cycle. For example, when a commercial vehicle runs downhill for a long time on a road having a large slope, the exhaust valve needs to be opened for the second time at the end of a compression stroke, so that the internal combustion engine generates brake power, thereby improving driving safety. To implement energy conservation and emission reduction of the internal combustion engine, under some operating conditions, the intake valve needs to be reopened during an exhaust stroke, so as to implement exhaust gas recirculation (EGR) or improve exhaust thermal management performance. Because the operating condition of the internal combustion engine changes frequently, the internal combustion engine needs to stably implement a switchover between a single-opening working mode and a two-opening (or multi-opening) working mode of the valve in the running process of the internal combustion engine.

Currently, a JackBrake engine brake device is a typical exhaust valve multi-opening device, and is implemented through charging or power-off of a solenoid valve, causing a swing arm shaft brake oil passage to be in an oil-flushing or non-oil-flushing state, and a brake piston to be in an extended or retracted position, to implement the switchover between the multi-opening and the single-opening of the exhaust valve. However, the JackBrake engine brake device also has problems such as a large exhaust cam lift, a deep piston top valve pit that needs to be provided, and a relatively complex structure.

SUMMARY

To overcome the disadvantages in the prior art, the present invention provides a hydraulic valve mechanism that enables an internal combustion engine to implement a single-opening working mode, a two-opening working mode, and even a multi-opening working mode of a valve in one working cycle, and implements a stable switchover among various working modes in the running process. The hydraulic valve mechanism with variable valve opening times effectively expands the working mode of the internal combustion engine, and has an important effect in energy conservation and emission reduction and driving safety of a vehicle.

A hydraulic valve mechanism with variable valve opening times is provided, including:

a housing, provided with a first oil passage and a second oil passage;

a valve cam, where the valve cam includes a main protrusion and at least one auxiliary protrusion, the valve cam is rotatable, and the valve cam is disposed outside the housing;

a hydraulic rotary valve, disposed in the housing and forming a hydraulic rotary valve oil chamber with the housing, where the hydraulic rotary valve includes a valve sleeve and a valve core provided with an axial hole, the valve core is installed in an inner hole of the valve sleeve, the valve core and the valve sleeve rotate around the same axis and are provided with radial oil holes at corresponding axial positions respectively, when the radial oil holes of the valve core and the valve sleeve are in communication, the hydraulic rotary valve is in an open state, when the radial oil holes of the valve core and the valve sleeve are mutually staggered, the hydraulic rotary valve is in a closed state, the hydraulic rotary valve oil chamber is in communication with the first oil passage, and the axial hole of the valve core is in communication with the second oil passage;

a hydraulic drive component, supported by the housing and forming a hydraulic drive oil chamber with the housing, where the hydraulic drive component is driven by the valve cam, and the hydraulic drive oil chamber is in communication with the first oil passage; and a valve drive component, supported by the housing and forming a valve drive oil chamber with the housing, where the valve drive oil chamber is in communication with the first oil passage, when the radial oil holes of the valve core and the valve sleeve are mutually staggered, the hydraulic rotary valve is in the closed state, and the hydraulic drive component drives the valve drive component to open a corresponding valve.

Further, the auxiliary protrusion in the valve cam is disposed at a position of a non-main protrusion in the valve cam.

Further, a valve camshaft drives, through a hydraulic rotary valve transmission mechanism, the valve core to rotate, a rotation speed ratio of the valve camshaft to the valve core is N, and N is a positive integer.

Further, the radial oil holes having the same quantity as the rotation speed ratio N are uniformly distributed in the same circumference of the hydraulic rotary valve core. The valve core radial oil hole is a through hole, and is in communication with the valve core axial hole. The hydraulic rotary valve sleeve is disposed on the circumference of the axial position corresponding to the valve core radial oil hole, and is provided with radial oil holes matching the auxiliary protrusion of the valve cam, and the valve sleeve radial oil hole is a through hole.

Further, an end portion of the valve sleeve is provided with gear teeth. The gear teeth are connected to a hydraulic rotary valve adjustment mechanism, and the hydraulic rotary valve adjustment mechanism drives the gear teeth to rotate, to further drive the valve sleeve to rotate.

Alternatively, the valve camshaft drives, through the hydraulic rotary valve transmission mechanism, the valve sleeve to rotate, a rotation speed ratio of the valve camshaft to the valve sleeve is N, and N is a positive integer. The radial oil holes having the same quantity as the rotation speed ratio N are uniformly distributed in the same circumference of the hydraulic rotary valve sleeve, and the valve sleeve radial oil hole is a through hole. The hydraulic rotary valve core is disposed on the circumference of the axial position corresponding to the valve sleeve radial oil hole, and is provided with radial oil holes matching the auxiliary protrusion of the valve cam, and the valve core radial oil hole is a through hole and is in communication with the valve core axial hole. An end portion of the valve core is provided with gear teeth, the gear teeth are connected to a hydraulic rotary valve adjustment mechanism, and the hydraulic rotary valve adjustment mechanism drives the gear teeth to rotate, to further drive the valve core to rotate.

Further, a product of a sum of an inner arc central angle of the valve sleeve radial oil hole and an outer arc central angle of the valve core radial oil hole multiplied by the rotation speed ratio N is greater than or equal to a valve cam rotation angle occupied by an upward section of the auxiliary protrusion matching the radial oil hole.

Further, the hydraulic rotary valve adjustment mechanism includes a motor or a proportional electromagnet and a gear or a gear rack or a gear sector, and the motor or the proportional electromagnet meshes with the gear teeth through a gear or a gear rack or a gear sector.

Further, a hydraulic one-way valve is disposed in the housing. An inlet of the hydraulic one-way valve is in communication with the second oil passage, and an outlet of the hydraulic one-way valve is in communication with the first oil passage.

Further, the housing is provided with a hydraulic accumulator. The accumulator forms an energy storage oil chamber with the housing, and the energy storage oil chamber is in communication with the second oil passage.

Further, the hydraulic drive component directly matches the valve cam; or in another solution, the hydraulic drive component matches the valve cam through a roller swing arm, a fixed end of the roller swing arm is supported by a ball head, the ball head is disposed on the housing, and the roller swing arm is in contact with the hydraulic drive component.

The present invention further provides an internal combustion engine, including the hydraulic valve mechanism with variable valve opening times.

When the hydraulic valve mechanism with variable valve opening times of the present invention is installed on the internal combustion engine, an internal combustion engine lubrication system is in communication with the second oil passage disposed on the housing. When an internal combustion engine crankshaft rotates, the crankshaft drives the valve camshaft to operate, the valve camshaft drives the main protrusion and the auxiliary protrusion of the valve cam to drive a hydraulic tappet in the hydraulic drive component, and the hydraulic tappet cooperates with a tappet spring to enable the hydraulic tappet to do reciprocal rectilinear motion. In addition, the internal combustion engine lubrication system provides low pressure oil to the second oil passage on the housing.

The hydraulic valve mechanism with variable valve opening times is provided with the first oil passage on the housing, and the first oil passage is in communication with the hydraulic drive oil chamber, the hydraulic rotary valve oil chamber, and the valve drive oil chamber. When the internal combustion engine is in a single-opening working mode of the valve, if the main protrusion drives the hydraulic tappet in the hydraulic drive component to do the reciprocal rectilinear motion, the hydraulic rotary valve is in a closed state. When the main protrusion drives the hydraulic tappet to increase oil pressure in the first oil passage, and the hydraulic oil in the first oil passage flows into the valve drive oil chamber, to push a hydraulic piston in the valve drive component to open the valve against a valve spring force, the valve is in a normal open/closed state. If the auxiliary protrusion drives the hydraulic tappet to do the reciprocal rectilinear motion, in this case, the hydraulic rotary valve is in an open state. When the auxiliary protrusion drives the hydraulic tappet to enable the hydraulic oil in the first oil passage to flow into the second oil passage through the hydraulic rotary valve, the valve is in a closed state. Therefore, the valve is opened only once in one working cycle.

When the internal combustion engine is in a two-opening working mode or a multi-opening working mode of the valve, the main protrusion drives the hydraulic tappet in the hydraulic drive component to do the reciprocal rectilinear motion, the hydraulic rotary valve is in a closed state, and the valve is in a normal open/closed state. If the auxiliary protrusion drives the hydraulic tappet to do the reciprocal rectilinear motion, in this case, the hydraulic rotary valve is in a closed state. The auxiliary protrusion drives the hydraulic tappet to increase the oil pressure in the first oil passage, and the hydraulic oil in the first oil passage flows into the valve drive oil chamber, to push the hydraulic piston in the valve drive component to open the valve against the valve spring force, so that the valve is reopened in the same working cycle. If two auxiliary protrusions are disposed on the valve cam, the valve is opened three times in the same working cycle, and so on.

When a roller swing arm is installed on the housing, the valve cam drives the roller swing arm to swing around a ball head along with the rotation of the camshaft, the roller swing arm pushes the hydraulic tappet, and the hydraulic tappet does the reciprocal rectilinear motion under the combined action of the roller swing arm and the tappet spring.

The valve camshaft drives, through the hydraulic rotary valve transmission mechanism, the valve core and the camshaft to synchronously rotate. The motor or the proportional electromagnet drives, through the hydraulic rotary valve adjustment mechanism, the gear teeth at the end portion of the valve sleeve to enable the valve sleeve to rotate, so as to change an opening time of the hydraulic rotary valve. If changing the opening time of the hydraulic rotary valve enables an upward section of the auxiliary protrusion matching the radial oil hole to be in an opening period of the hydraulic rotary valve, when the auxiliary protrusion drives the hydraulic tappet to ascend, the oil in the first oil passage flows into the second oil passage through the hydraulic rotary valve, the valve cannot be opened, and the internal combustion engine is in the single-opening working mode of the valve. If changing the opening time of the hydraulic rotary valve enables the upward section of the auxiliary protrusion matching the radial oil hole to be in a closed period of the hydraulic rotary valve, when the auxiliary protrusion drives the hydraulic tappet to ascend, the oil in the first oil passage flows into the valve drive oil chamber, the valve is opened, and the internal combustion engine is in the two-opening working mode or even the multi-opening working mode.

When the main protrusion or the auxiliary protrusion of the valve cam is in a descending process, the volume of the hydraulic drive oil chamber is increased along with the descending of the hydraulic tappet. When pressure of the hydraulic oil in the first oil passage is reduced to be lower than pressure of the hydraulic oil in the second oil passage, a hydraulic one-way valve is opened, and the second oil passage supplies the hydraulic oil to the first oil passage through the hydraulic one-way valve, to ensure that the hydraulic oil always fills the hydraulic drive oil chamber, the valve drive oil chamber, and the first oil passage.

Because the hydraulic rotary valve is intermittently opened and closed, the oil pressure in the second oil passage is unstable. The hydraulic accumulator is used for storing and releasing the hydraulic pressure energy, to reduce fluctuation of the hydraulic pressure in the second oil passage, and the second oil passage supplies stable hydraulic oil to the first oil passage through the hydraulic one-way valve.

In the hydraulic valve mechanism with variable valve opening times of the present invention, the hydraulic tappet in the hydraulic drive component, the valve core in the hydraulic rotary valve, and the hydraulic piston in the valve drive component are all moving elements. To reduce oil leakage, it is necessary to use gap seal. Therefore, the hydraulic drive component includes the hydraulic tappet/tappet sleeve pair, the hydraulic rotary valve includes the valve core/valve sleeve pair, the valve drive component includes the hydraulic piston/piston sleeve pair, and the like.

Obviously, if the valve sleeve of the hydraulic rotary valve is provided with the radial oil hole corresponding to the main protrusion, functions of reducing the valve lift corresponding to the main protrusion, closing the valve in advance and the like can be implemented. Therefore, the present invention not only can implement the variable valve opening times, but also can simultaneously implement continuous variable of the lift and valve timing of the intake valve or the exhaust valve.

Compared with the prior art, beneficial effects of the present invention are as follows:

(1) The exhaust valve is reopened at a later stage of a compression stroke and an early stage of an intake stroke, so that an exhaust brake working mode can be implemented.

(2) The intake valve is reopened in the exhaust stroke, so that some exhaust gas flows back to an intake pipe, and joins a combustion process of a next cycle, thereby improving the exhaust thermal management performance.

(3) In the exhaust brake working mode, the intake valve is reopened in an original expansion stroke, so as to implement the second intake (the first intake is the intake process), thereby reducing thermal loads in the exhaust brake working mode, and improving the brake efficiency.

(4) A switchover between the two-opening (or multi-opening) mode and the single-opening mode of the valve can be implemented according to a specific situation, and the switchover process is stable, rapid, and shock-free.

(5) The present invention can implement, through the hydraulic valve mechanism with variable valve opening times, multi-opening of the valve of the internal combustion engine in the same working cycle, and greatly expand the working mode of the internal combustion engine.

BRIEF DESCRIPTION OF THE DRAWINGS

The accompanying drawings of the specification constituting a part of the present invention are used for providing a further understanding of the present invention. The exemplary embodiments and description thereof of the present invention are intended to explain the present invention, and do not constitute an inappropriate limitation to the present invention.

DETAILED DESCRIPTION

Figure 1:
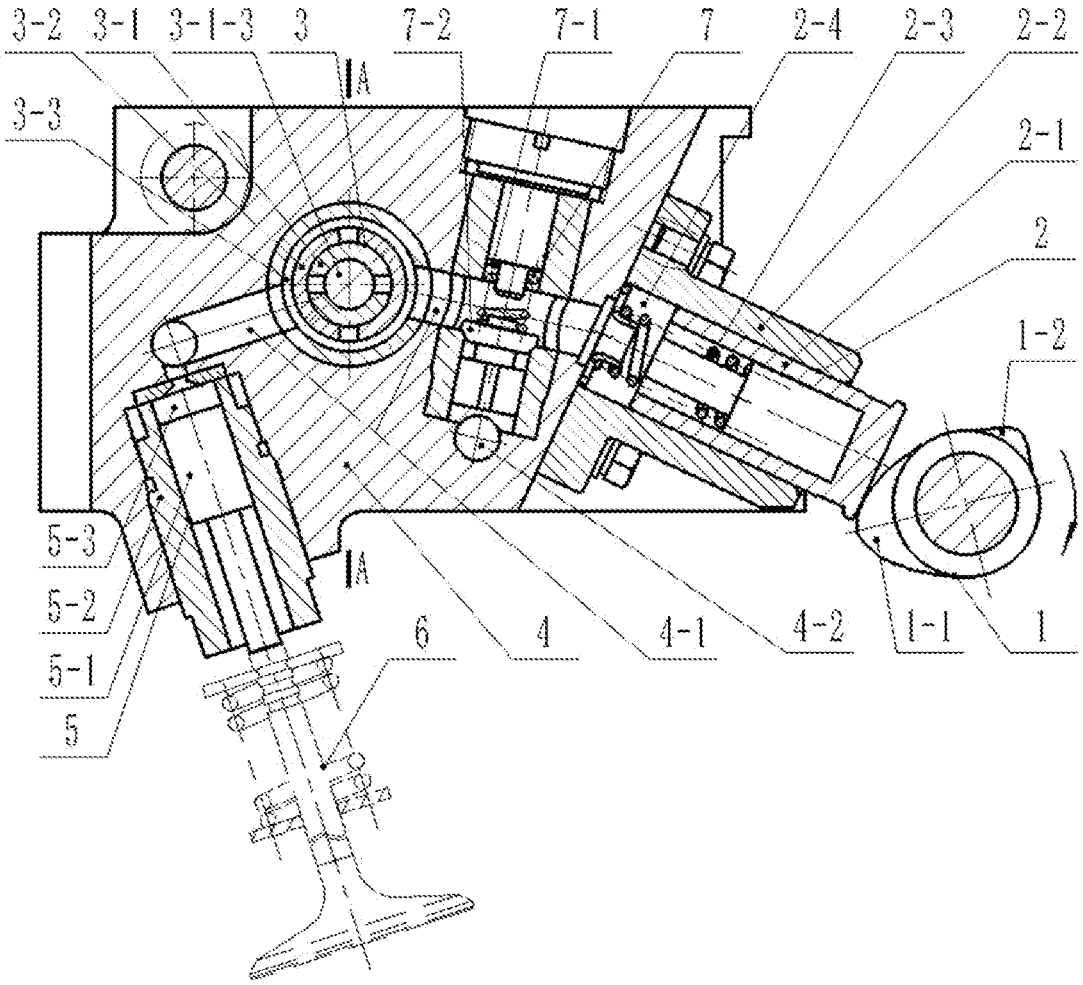
FIG. 1 is a schematic diagram of a hydraulic valve mechanism with variable valve opening times according to the present invention.
Figure 2:
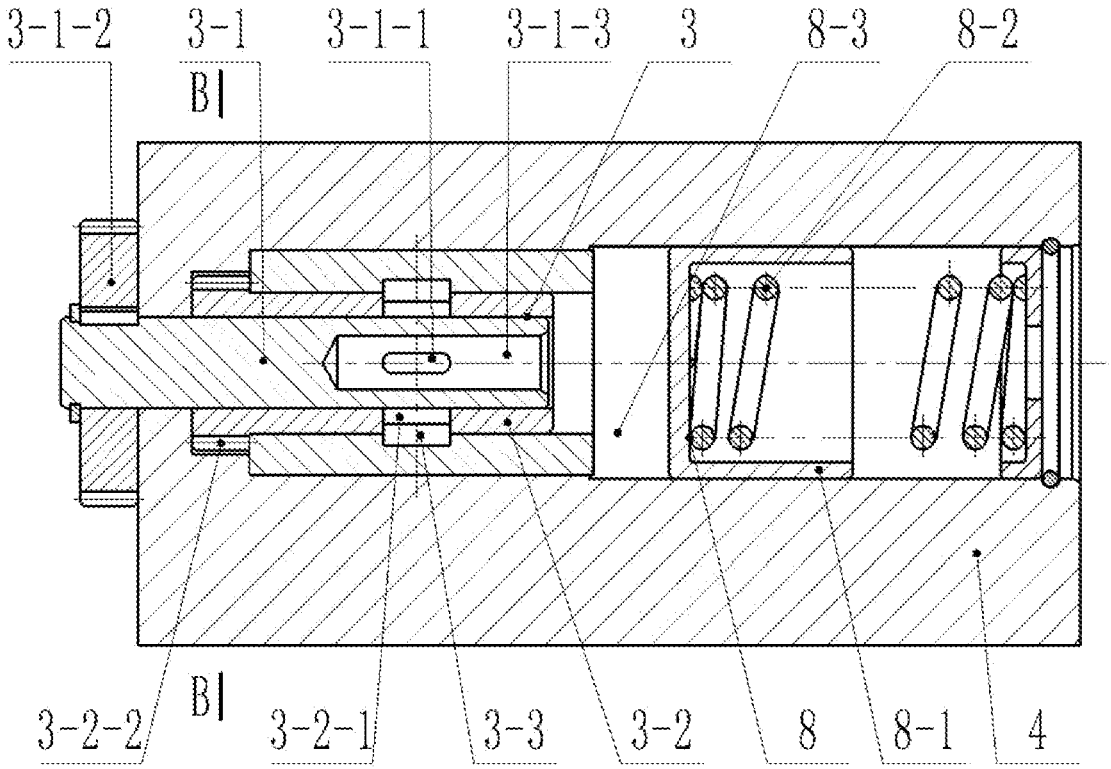
FIG. 2 is a cross-sectional view of A-A in FIG. 1.
Figure 3:
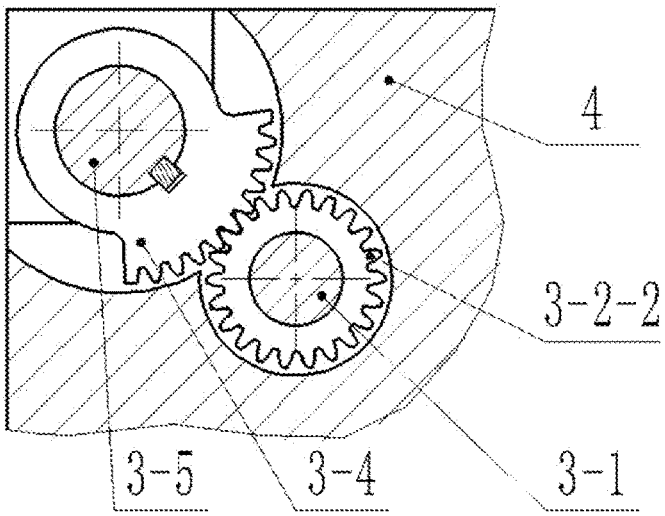
FIG. 3 is a cross-sectional view of B-B in FIG. 2.

To make the technical problems, the technical solutions, and advantages of the present invention that are to be resolved more clearly, detailed description is made below with reference to the accompanying drawings and specific embodiments.

Embodiment 1

This embodiment provides a hydraulic valve mechanism with variable valve opening times, as shown in FIG. 1 to FIG. 6, including a valve cam 1, a hydraulic drive component 2, a hydraulic rotary valve 3, a housing 4, and a valve drive component 5. The valve drive component 5 drives a valve in a valve assembly 6. The valve assembly 6 belongs to the prior art, and includes the valve and a valve spring. Details are not described again.

The housing 4 is provided with a first oil passage 4-1 and a second oil passage 4-2.

The valve cam 1 includes a main protrusion 1-1 and an auxiliary protrusion 1-2. The valve cam 1 is an exhaust cam or an intake cam. The main protrusion 1-1 of the exhaust cam is a protrusion for opening an exhaust valve in an exhaust stroke, and the auxiliary protrusion 1-2 of the exhaust cam is disposed at a certain position of the exhaust cam corresponding to an intake stroke, a compression stroke, and an expansion stroke. The main protrusion 1-1 of the intake cam is a protrusion for opening an intake valve in the intake stroke, and the auxiliary protrusion 1-2 of the intake cam is disposed at a certain position of the intake cam corresponding to the compression stroke, the expansion stroke, and the exhaust stroke.

The hydraulic drive component 2 includes a hydraulic tappet 2-1, a tappet sleeve 2-2, and a tappet spring 2-3. The hydraulic tappet 2-1 and the tappet sleeve 2-2 form a hydraulic tappet/tappet sleeve pair. The hydraulic drive component 2 is installed on the housing 4 and forms a hydraulic drive oil chamber 2-4 with the housing 4, and the hydraulic drive oil chamber 2-4 is in communication with the first oil passage 4-1. The hydraulic tappet 2-1 in the hydraulic drive component 2 is driven by the valve cam 1.

The hydraulic rotary valve 3 is disposed in the housing 4 and forms a hydraulic rotary valve oil chamber 3-3 with the housing 4. The hydraulic rotary valve 3 includes a valve sleeve 3-2 and a valve core 3-1 provided with a valve core axial hole 3-1-3, and the valve core 3-1 is installed in an inner hole of the valve sleeve 3-2 to form a valve core/valve sleeve pair. The valve core 3-1 and the valve sleeve 3-2 rotate around the same axis and are provided with radial oil holes at corresponding axial positions respectively. When a valve core radial oil hole 3-1-1 and a valve sleeve radial oil hole 3-2-1 are in communication, the hydraulic rotary valve 3 is in an open state. When the valve core radial oil hole 3-1-1 and the valve sleeve radial oil hole 3-2-1 are mutually staggered, the hydraulic rotary valve 3 is in a closed state. The hydraulic rotary valve oil chamber 3-3 is in communication with the first oil passage 4-1, and the valve core axial hole 3-1-3 is in communication with the second oil passage 4-2.

The valve drive component 5 includes a hydraulic piston 5-1 and a piston sleeve 5-2, where the hydraulic piston 5-1 and the piston sleeve 5-2 form a hydraulic piston/piston sleeve pair. The valve drive component 5 is supported through the housing 4 and forms a valve drive oil chamber 5-3 with the housing, where the valve drive oil chamber 5-3 is in communication with the first oil passage 4-1. When the valve core radial oil hole 3-1-1 and the valve sleeve radial oil hole 3-2-1 are mutually staggered, the hydraulic rotary valve 3 is in a closed state. The main protrusion 1-1 or the auxiliary protrusion 1-2 of the valve cam 1 drives the hydraulic tappet 2-1 in the hydraulic drive component 2, to reduce the volume of the hydraulic drive oil chamber 2-4 to generate high-pressure oil. The high-pressure oil enters the valve drive oil chamber 5-3 through the first oil passage 4-1, and pushes the hydraulic piston 5-1 to open the valve.

When the hydraulic valve mechanism with variable valve opening times in this embodiment is installed on an internal combustion engine, an internal combustion engine lubrication system is in communication with the second oil passage 4-2 disposed on the housing 4. When an internal combustion engine crankshaft rotates, the crankshaft drives a valve camshaft 11 to operate, the valve camshaft 11 drives the main protrusion 1-1 and the auxiliary protrusion 1-2 of the valve cam 1 to drive the hydraulic tappet 2-1 in the hydraulic drive component 2, and the hydraulic tappet cooperates with the tappet spring 2-3 to enable the hydraulic tappet 2-1 to do reciprocal rectilinear motion. In addition, the internal combustion engine lubrication system provides low pressure oil to the second oil passage 4-2 on the housing 4.

The hydraulic valve mechanism with variable valve opening times in this embodiment is provided with the first oil passage 4-1 on the housing 4, and the first oil passage 4-1 is in communication with the hydraulic drive oil chamber 2-4, the hydraulic rotary valve oil chamber 3-3, and the valve drive oil chamber 5-3. When the internal combustion engine is in a single-opening working mode of the valve, if the main protrusion 1-1 drives the hydraulic tappet 2-1 in the hydraulic drive component 2 to do the reciprocal rectilinear motion, the valve core radial oil hole 3-1-1 and the valve sleeve radial oil hole 3-2-1 of the hydraulic rotary valve 3 are staggered, so the hydraulic rotary valve 3 is in a closed state. In this case, the main protrusion 1-1 drives the hydraulic tappet 2-1 to increase oil pressure in the first oil passage 4-1, and hydraulic oil in the first oil passage 4-1 flows into the valve drive oil chamber 5-3, to push the hydraulic piston 5-1 in the valve drive component 5 to open the valve against a valve spring force, so that the valve is in a normal open/closed state. If the auxiliary protrusion 1-2 drives the hydraulic tappet 2-1 to do the reciprocal rectilinear motion, in this case, the valve core radial oil hole 3-1-1 of the hydraulic rotary valve 3 just rotates to a position in which the valve core radial oil hole 3-1-1 is in communication with the valve sleeve radial oil hole 3-2-1, so that the hydraulic rotary valve 3 is in an open state. In this case, the auxiliary protrusion 1-2 drives the hydraulic tappet 2-1 to enable the hydraulic oil in the first oil passage 4-1 to flow into the second oil passage 4-2 through the hydraulic rotary valve oil chamber 3-3, the valve sleeve radial oil hole 3-2-1, the valve core radial oil hole 3-1-1, and the valve core axial hole 3-1-3 sequentially, causing that the hydraulic piston 5-1 cannot open the valve against the valve spring force, and the valve is in a closed state. Therefore, the valve is opened only once in one working cycle. When the internal combustion engine is in a two-opening working mode or a multi-opening working mode of the valve, the main protrusion 1-1 drives the hydraulic tappet 2-1 in the hydraulic drive component 2 to do the reciprocal rectilinear motion, the hydraulic rotary valve 3 is in a closed state, and the valve is in a normal open/closed state. If the auxiliary protrusion 1-2 drives the hydraulic tappet 2-1 to do the reciprocal rectilinear motion, in this case, the valve core radial oil hole 3-1-1 and the valve sleeve radial oil hole 3-2-1 of the hydraulic rotary valve 3 are staggered, so that the hydraulic rotary valve 3 is in a closed state. The auxiliary protrusion 1-2 drives the hydraulic tappet 2-1 to increase the oil pressure in the first oil passage 4-1, and the hydraulic oil in the first oil passage 4-1 flows into the valve drive oil chamber 5-3, to push the hydraulic piston 5-1 in the valve drive component 5 to open the valve against the valve spring force, so that the valve is reopened in the same working cycle.

When the internal combustion engine is in an operating state, the crankshaft drives the valve camshaft 11 to operate. The valve camshaft 11 is provided with a camshaft gear 11-1. The hydraulic rotary valve transmission mechanism includes the camshaft gear 11-1, an intermediate transmission gear 3-6, and a valve core end gear 3-1-2. The valve camshaft 11 drives, through the hydraulic rotary valve transmission mechanism, the valve core 3-1 to synchronously rotate, and a rotation speed ratio N of the valve camshaft 11 to the valve core 3-1 is 2 in this embodiment. Two valve core radial oil holes 3-1-1 having the same quantity as the rotation speed ratio N are uniformly distributed on the same circumference of the valve core 3-1 of the hydraulic rotary valve 3, and the valve core radial oil hole 3-1-1 is a through hole and is in communication with the valve core axial hole 3-1-3. The valve sleeve 3-2 of the hydraulic rotary valve 3, on the circumference of the axial position corresponding to the valve core radial oil hole 3-1-1, is provided with two valve sleeve radial oil holes 3-2-1 matching the auxiliary protrusion 1-2 of the valve cam 1, and the valve sleeve radial oil hole 3-2-1 is also a through hole and is in communication with the hydraulic rotary valve oil chamber 3-3.

An end portion of the valve sleeve 3-2 is provided with valve sleeve end gear teeth 3-2-2, and the valve sleeve end gear teeth 3-2-2 are connected to a hydraulic rotary valve adjustment mechanism. The hydraulic rotary valve adjustment mechanism includes a stepping motor 12, a gear sector 3-4, and a toothed sector shaft 3-5. The stepping motor 12 and the toothed sector shaft 3-5 are supported through the housing 4. The stepping motor 12 drives the toothed sector shaft 3-5 to enable the gear sector 3-4 to rotate. The gear sector 3-4 drives the valve sleeve end gear teeth 3-2-2 to rotate, to further drive the valve sleeve radial oil hole 3-2-1 on the valve sleeve 3-2 to rotate. The hydraulic rotary valve adjustment mechanism enables the radial oil hole 3-2-1 on the valve sleeve 3-2 to rotate in a forward direction or a reverse direction within a set angle range, to change an opening time and a closing time of the hydraulic rotary valve 3.

Figure 6:
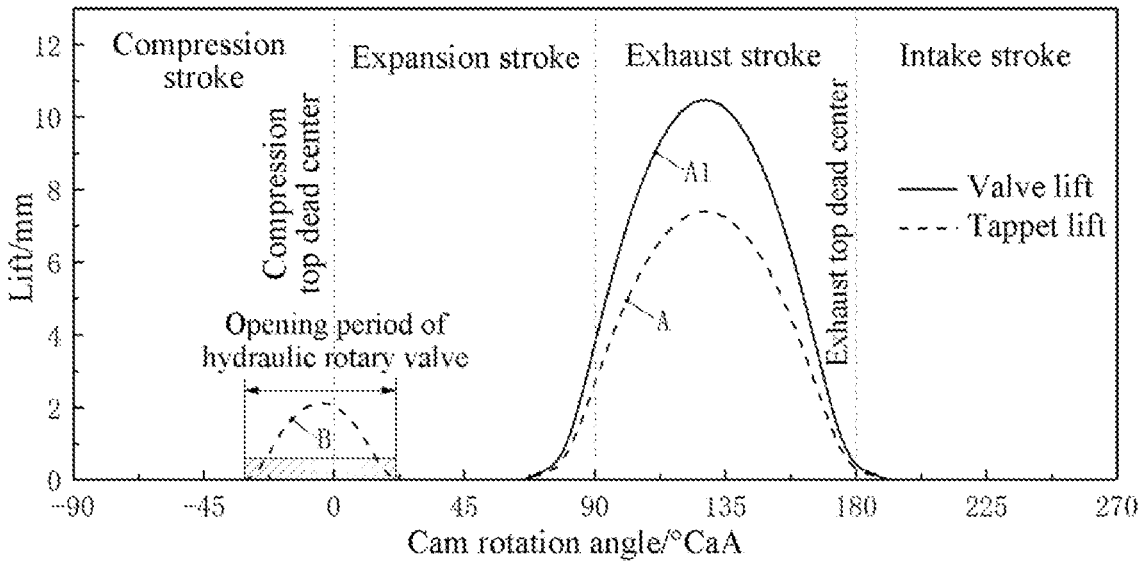
FIG. 6 is a schematic diagram of valve lift and tappet lift during a single-opening working mode according to the present invention.

The valve sleeve 3-2 is further rotated to change the opening time of the hydraulic rotary valve 3, so that an upward section of the auxiliary protrusion 1-2 matching the radial oil hole is in an opening period of the hydraulic rotary valve, as shown in FIG. 6. When the hydraulic rotary valve 3 is in an open state, the auxiliary protrusion 1-2 drives the hydraulic tappet 2-1 to enable the hydraulic oil in the first oil passage 4-1 to flow into the second oil passage 4-2 through the hydraulic rotary valve oil chamber 3-3, the valve sleeve radial oil hole 3-2-1, the valve core radial oil hole 3-1-1, and the valve core axial hole 3-1-3 sequentially, causing that the hydraulic piston 5-1 cannot open the valve against the valve spring force, and the auxiliary protrusion 1-2 cannot open the valve. In a corresponding position of the auxiliary protrusion 1-2 shown in FIG. 6, only a lift curve B of the hydraulic tappet 2-1 exists, and the valve lift is zero. A valve lift curve A1 and a tappet lift curve A exist at a corresponding position of the main protrusion 1-1. Therefore, the valve is opened only once at the position of the main protrusion 1-1 in one working cycle of the internal combustion engine, and the valve lift curve is A1.

Figure 7:
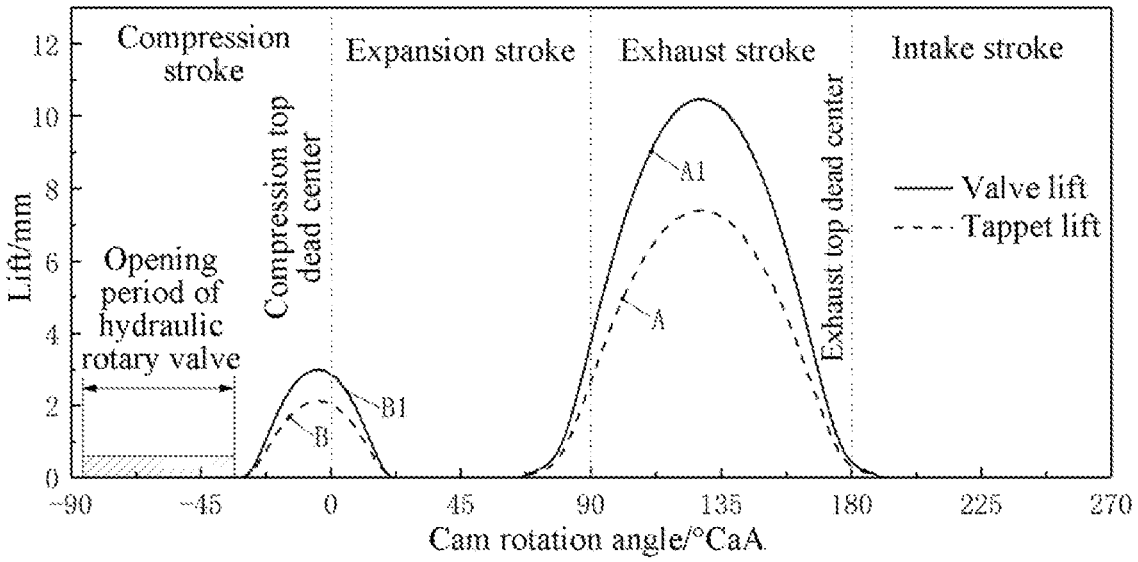
FIG. 7 is a schematic diagram of valve lift and tappet lift during a two-opening mode according to the present invention.

The valve sleeve 3-2 is rotated by a set angle against the rotation direction of the valve core 3-1, so that the opening period of the hydraulic rotary valve is moved from the position shown in FIG. 6 to the position shown in FIG. 7. In FIG. 7, when the auxiliary protrusion 1-2 drives the hydraulic tappet 2-1 to do the motion, the valve core radial oil hole 3-1-1 and the valve sleeve radial oil hole 3-2-1 of the hydraulic rotary valve 3 are staggered, so that the hydraulic rotary valve 3 is in a closed state. In this case, the auxiliary protrusion 1-2 drives the hydraulic tappet 2-1 to increase the oil pressure in the first oil passage 4-1, and hydraulic oil in the first oil passage 4-1 flows into the valve drive oil chamber 5-3, to push the hydraulic piston 5-1 in the valve drive component 5 to open the valve against the valve spring force. In a corresponding position of the auxiliary protrusion 1-2 shown in FIG. 7, a valve lift curve B1 and a tappet lift curve B exist, and a valve lift curve A1 and a tappet lift curve A exist at a corresponding position of the main protrusion 1-1. Therefore, the valve is reopened in the corresponding positions of the main protrusion 1-1 and the auxiliary protrusion 1-2 in one working cycle of the internal combustion engine.

The opening period of the hydraulic rotary valve refers to a cam rotation angle starting from the valve core radial oil hole 3-1-1 and the valve sleeve radial oil hole 3-2-1 just in communication and ending of the valve core radial oil hole 3-1-1 and the valve sleeve radial oil hole 3-2-1 just staggered. Therefore, a product of a sum of an inner arc central angle of the valve sleeve radial oil hole 3-2-1 and an outer arc central angle of the valve core radial oil hole 3-1-1 multiplied by the rotation speed ratio N is the opening period of the hydraulic rotary valve. The opening period of the hydraulic rotary valve should be greater than or equal to a valve cam rotation angle occupied by the upward section of the auxiliary protrusion matching the radial oil hole, so as to ensure that the valve cannot be opened at the upward section of the auxiliary protrusion.

When the main protrusion 1-1 or the auxiliary protrusion 1-2 of the valve cam 1 is in a downward section, along with the descending of the hydraulic tappet 2-1, the volume of the hydraulic drive oil chamber 2-4 is increased, and pressure of the hydraulic oil in the first oil passage 4-1 is gradually reduced. When the pressure of the hydraulic oil in the first oil passage 4-1 is reduced to be lower than pressure of the hydraulic oil in the second oil passage 4-2, a one-way valve core 7-2 of a hydraulic one-way valve 7 moves upward under the action of a pressure difference, to compress a one-way valve spring 7-1, so that the hydraulic one-way valve 7 is opened, and the second oil passage 4-2 supplies hydraulic oil to the first oil passage 4-1 through the hydraulic one-way valve 7, to ensure that the hydraulic oil always fills the hydraulic drive oil chamber 2-4, the valve drive oil chamber 5-3, and the hydraulic rotary valve oil chamber 3-3.

Because the hydraulic rotary valve 3 is intermittently opened and closed, the oil pressure in the second oil passage 4-2 is unstable, and a hydraulic accumulator 8 is used for storing and releasing hydraulic pressure energy. When instantaneous pressure of an energy storage oil chamber 8-5 is increased, an energy storage piston 8-1 compresses an energy storage spring 8-2, to increase the volume of the energy storage oil chamber 8-3, and reduce the pressure. When the instantaneous pressure of the energy storage oil chamber 8-5 is reduced, the energy storage spring 8-2 is extended, to reduce the volume of the energy storage oil chamber 8-3, and increase the pressure. Therefore, the oil pressure in the energy storage oil chamber 8-3 and the second oil passage 4-2 remains stable, and the second oil passage 4-2 may supply stable hydraulic oil to the first oil passage 4-1 through the hydraulic one-way valve 7.

Figure 5:
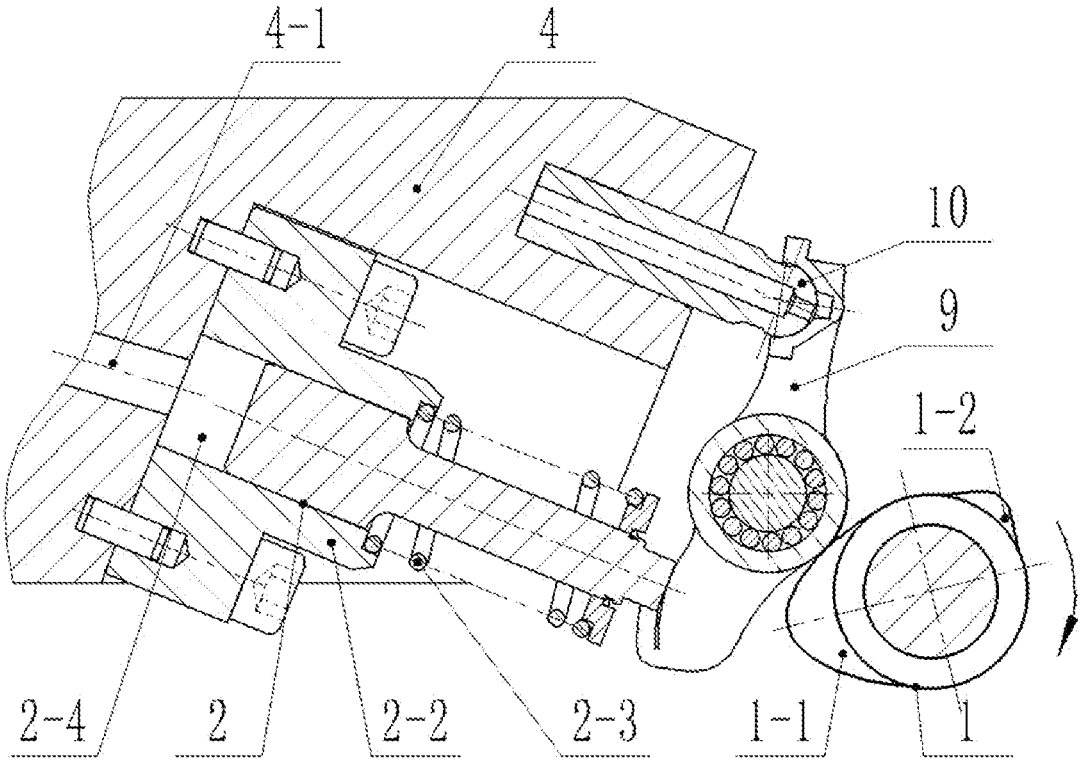
FIG. 5 is a schematic diagram of a hydraulic drive component including a roller swing arm.

To reduce friction between the valve cam and the hydraulic tappet, a roller swing arm may be added between the hydraulic tappet and the valve cam. As shown in FIG. 5, the hydraulic tappet 2-1 of the hydraulic drive component 2 matches the valve cam 1 through a roller swing arm 9, a fixed end of the roller swing arm 9 is supported by a ball head 10, and the ball head 10 is disposed on the housing 4. The roller swing arm 9 is in contact with the hydraulic tappet 2-1 of the hydraulic drive component 2, and the hydraulic tappet 2-1 does the reciprocal rectilinear motion under the combined action of the roller swing arm 9 and the tappet spring 2-3.

In the hydraulic valve mechanism, because cross-sectional areas of the hydraulic tappet 2-1 and the hydraulic piston 5-1 are different, strokes of the hydraulic tappet 2-1 and the hydraulic piston 5-1 are different at the same time, so that a set proportional relationship exists between the valve lift and the tappet lift, that is, a lift ratio is implemented, as shown in FIG. 6 and FIG. 7. The lift ratio is equal to a ratio of the cross-sectional area of the hydraulic tappet 2-1 to the cross-sectional area of the hydraulic piston 5-1.

The corresponding position of the auxiliary protrusion of the exhaust cam is set to be at the later stage of the compression stroke and the early stage of the intake stroke. When the internal combustion engine is in the two-opening working mode or the multi-opening working mode of the valve, the exhaust valve is reopened at the later stage of the compression stroke and the early stage of the intake stroke, so that the in-cylinder exhaust brake working mode can be implemented, as shown in FIG. 7.

The corresponding position of the auxiliary protrusion of the intake cam is set to be in the exhaust stroke. When the internal combustion engine is in the two-opening working mode or the multi-opening working mode of the valve, the intake valve is reopened in the exhaust stroke, so that some exhaust gas flows back to an intake pipe, and joins a combustion process of a next cycle, to improve an exhaust temperature, thereby improving the exhaust thermal management performance.

The corresponding position of the auxiliary protrusion of the intake cam is set to be in the expansion stroke, and the corresponding position of the auxiliary protrusion of the exhaust cam is set to be in the later stage of the compression stroke and the early stage of the intake stroke. In the exhaust brake working mode, the intake valve is reopened in an original expansion stroke, so as to implement the second intake (the first intake is the intake process), thereby reducing thermal loads in the exhaust brake working mode, and improving the brake efficiency.

The auxiliary protrusion of the exhaust cam and the auxiliary protrusion of the intake cam are disposed at a plurality of different positions, so that the internal combustion engine may further implement a plurality of different functions.

The opening time of the hydraulic rotary valve 3 is changed through the hydraulic rotary valve adjustment mechanism according to a specific situation, to implement a switchover between the two-opening (or multi-opening) mode and the single-opening mode of the valve. The switchover between the two-opening (or multi-opening) mode and the single-opening mode can be implemented by rotating the valve sleeve 3-2 of the hydraulic rotary valve 3 by the set angle. Therefore, the switchover process is stable, rapid, and shock-free.

Embodiment 2

This embodiment discloses an internal combustion engine, including the hydraulic valve mechanism with variable valve opening times in Embodiment 1. The housing 4 in the hydraulic valve mechanism is installed on the top of a cylinder head of the internal combustion engine and matches a valve assembly of the internal combustion engine.

Figure 4:
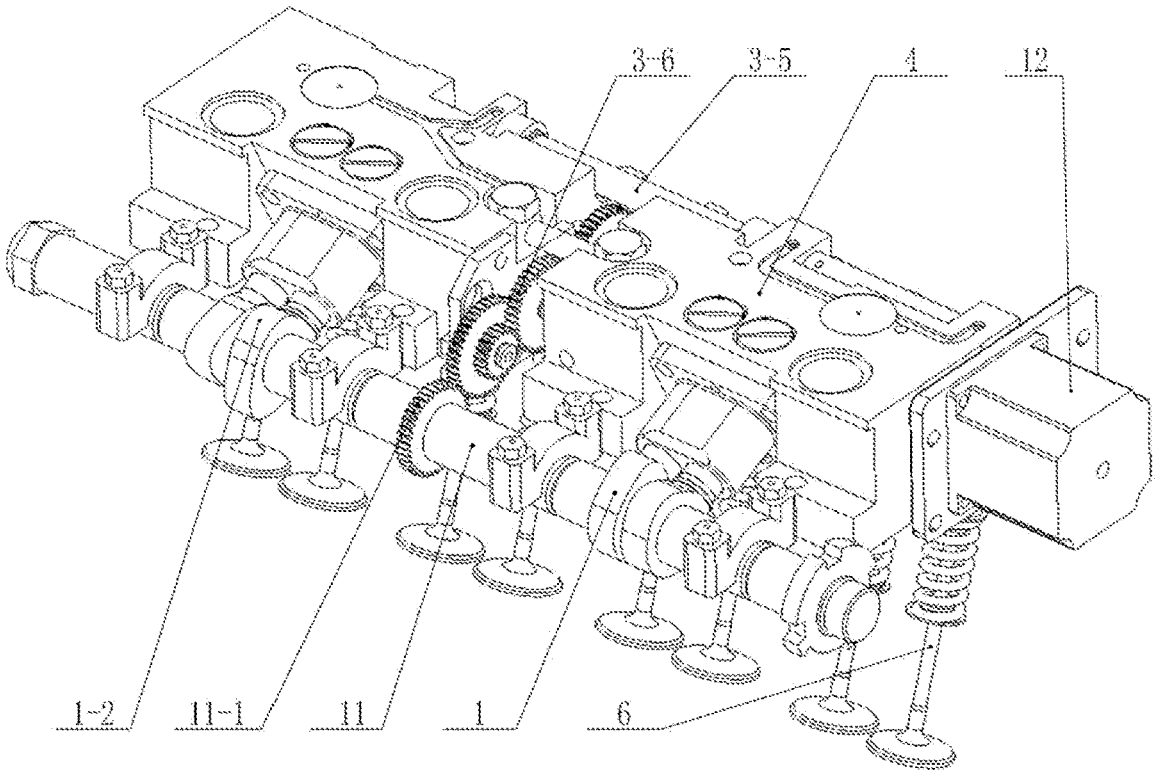
FIG. 4 is a schematic diagram of an appearance structure of a hydraulic valve mechanism according to the present invention.

As shown in FIG. 4, the valve cam 1 in the hydraulic valve mechanism is a valve cam disposed on a valve camshaft of the internal combustion engine. The center line of the valve core 3-1 in the hydraulic rotary valve 3 and the valve camshaft 11 are disposed in parallel. The gear in the hydraulic rotary valve transmission mechanism intermeshes, through the intermediate transmission gear 3-6, with the camshaft gear 11-1 disposed on the valve camshaft 11. In the optimal solution, four sets of hydraulic drive components 2, eight sets of valve drive components 5 (with a single-cylinder 4-valve structure), and four sets of hydraulic rotary valves 3 are disposed in the housing 4. The intermediate transmission gears 3-6 are disposed in the middle of the housing 4, and a plurality of valve cores 3-1 are driven, through one set of intermediate transmission gears 3-6, to rotate. The valve sleeve 3-2 in the hydraulic rotary valve 3 is driven, by the stepping motor 12 through the toothed sector shaft 3-5 and the gear sector 3-4, to rotate.

In other embodiments, the center line of the valve core 3-1 in the hydraulic rotary valve 3 and the valve camshaft 11 are disposed in a staggered manner.

The foregoing descriptions are merely preferred embodiments of the present invention, but are not intended to limit the present invention. A person skilled in the art may make various modifications and changes to the present invention. Any modification, equivalent replacement, or improvement made within the spirit and principle of the present disclosure shall fall within the protection scope of the present disclosure.

What is claimed is:

1. A hydraulic valve mechanism with variable valve opening times, the hydraulic valve mechanism comprising:

a housing, provided with a first oil passage and a second oil passage;

a valve cam, wherein the valve cam comprises a main protrusion and at least one auxiliary protrusion, the valve cam is rotatable, and the valve cam is disposed outside the housing;

a hydraulic rotary valve, disposed in the housing and forming a hydraulic rotary valve oil chamber with the housing, wherein the hydraulic rotary valve comprises a valve sleeve and a valve core provided with an axial hole, the valve core is installed in an inner hole of the valve sleeve, the valve core and the valve sleeve rotate around a same axis and are provided with radial oil holes at corresponding axial positions respectively, when the radial oil holes of the valve core and the valve sleeve are in communication, the hydraulic rotary valve is in an open state, when the radial oil holes of the valve core and the valve sleeve are mutually staggered, the hydraulic rotary valve is in a closed state, the hydraulic rotary valve oil chamber is in communication with the first oil passage, and the axial hole of the valve core is in communication with the second oil passage;

a hydraulic drive component, supported by the housing and forming a hydraulic drive oil chamber with the housing, wherein the hydraulic drive component is driven by the valve cam, and the hydraulic drive oil chamber is in communication with the first oil passage; and a valve drive component, supported by the housing and forming a valve drive oil chamber with the housing, wherein the valve drive oil chamber is in communication with the first oil passage, when the radial oil holes of the valve core and the valve sleeve are mutually staggered, the hydraulic rotary valve is in the closed state, and the hydraulic drive component drives the valve drive component to open a corresponding valve.

2. The hydraulic valve mechanism with variable valve opening times according to claim 1, wherein the auxiliary protrusion in the valve cam is disposed at a position of a non-main protrusion in the valve cam.

3. The hydraulic valve mechanism with variable valve opening times according to claim 1, wherein a valve camshaft drives, through a hydraulic rotary valve transmission mechanism, the valve core to rotate, a rotation speed ratio of the valve camshaft to the valve core is N, and N is a positive integer; or the valve camshaft drives, through the hydraulic rotary valve transmission mechanism, the valve sleeve to rotate, a rotation speed ratio of the valve camshaft to the valve sleeve is N, and N is a positive integer.

4. The hydraulic valve mechanism with variable valve opening times according to claim 3, wherein the radial oil holes having the same quantity as the rotation speed ratio N are uniformly distributed in the same axial position of the valve core, the valve core radial oil hole is a through hole and is in communication with the valve core axial hole, the valve sleeve is provided with a radial oil hole matching the auxiliary protrusion of the valve cam at the same axial position, the valve sleeve radial oil hole is a through hole, and the axial position of the valve sleeve radial oil hole corresponds to the axial position of the valve core radial oil hole; or the radial oil holes having the same quantity as the rotation speed ratio N are uniformly distributed in the same axial position of the valve sleeve, the valve sleeve radial oil hole is a through hole, the valve core is provided with a radial oil hole matching the auxiliary protrusion of the valve cam at the same axial position, the valve core radial oil hole is a through hole and is in communication with the valve core axial hole, and the axial position of the valve core radial oil hole corresponds to the axial position of the valve sleeve radial oil hole.

5. The hydraulic valve mechanism with variable valve opening times according to claim 1, wherein a product of a sum of an inner arc central angle of the valve sleeve radial oil hole and an outer arc central angle of the valve core radial oil hole multiplied by the rotation speed ratio N is greater than or equal to a valve cam rotation angle occupied by an upward section of the auxiliary protrusion matching the radial oil hole.

6. The hydraulic valve mechanism with variable valve opening times according to claim 1, wherein an end portion of the valve sleeve is provided with gear teeth, the gear teeth are connected to a hydraulic rotary valve adjustment mechanism, and the hydraulic rotary valve adjustment mechanism drives the gear teeth to rotate, to further drive the valve sleeve to rotate; or an end portion of the valve core is provided with gear teeth, the gear teeth are connected to a hydraulic rotary valve adjustment mechanism, and the hydraulic rotary valve adjustment mechanism drives the gear teeth to rotate, to further drive the valve core to rotate.

7. The hydraulic valve mechanism with variable valve opening times according to claim 6, wherein the hydraulic rotary valve adjustment mechanism comprises a motor or a proportional electromagnet and a gear or a gear rack or a gear sector, and the motor or the proportional electromagnet meshes with the gear teeth through a gear or a gear rack or a gear sector.

8. The hydraulic valve mechanism with variable valve opening times according to claim 1, wherein a hydraulic one-way valve is disposed in the housing, an inlet of the one-way valve is in communication with the second oil passage, and an outlet of the one-way valve is in communication with the first oil passage; and further, the hydraulic valve mechanism with variable valve opening times according to claim 1, wherein the housing is provided with a hydraulic accumulator, the accumulator forms an energy storage oil chamber with the housing, and the energy storage oil chamber is in communication with the second oil passage.

9. The hydraulic valve mechanism with variable valve opening times according to claim 1, wherein the hydraulic drive component matches the valve cam through a roller swing arm, a fixed end of the roller swing arm is supported by a ball head, the ball head is disposed on the housing, and the roller swing arm is in contact with the hydraulic drive component.

10. An internal combustion engine, characterized by comprising the hydraulic valve mechanism with variable valve opening times according to claim 1.

* * * * *